US008167690B2

(12) United States Patent
Fukuda et al.

(10) Patent No.: US 8,167,690 B2
(45) Date of Patent: May 1, 2012

(54) POLISHING PAD

(75) Inventors: Takeshi Fukuda, Osaka (JP); Satoshi Maruyama, Osaka (JP); Junji Hirose, Osaka (JP); Kenji Nakamura, Osaka (JP); Masato Doura, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 314 days.

(21) Appl. No.: 12/440,003

(22) PCT Filed: Apr. 23, 2007

(86) PCT No.: PCT/JP2007/058758

§ 371 (c)(1), (2), (4) Date: Mar. 4, 2009

(87) PCT Pub. No.: WO2008/029538

PCT Pub. Date: Mar. 13, 2008

(65) Prior Publication Data

US 2010/0029182 A1 Feb. 4, 2010

(30) Foreign Application Priority Data

Sep. 8, 2006 (JP) ..... 2006-244418

(51) Int. Cl.
*B24D 11/00* (2006.01)

(52) U.S. Cl. ..... 451/533; 451/530; 451/528

(58) Field of Classification Search ..... 451/526, 451/527, 528, 530, 533, 41
See application file for complete search history.

(56) References Cited

U.S. PATENT DOCUMENTS

| | | | | |
|---|---|---|---|---|
| 3,049,463 | A | 8/1962 | Kallander et al. | |
| 3,284,274 | A | 11/1966 | Hulslander et al. | |
| 4,216,177 | A | 8/1980 | Otto | |
| 5,409,770 | A | 4/1995 | Netsu et al. | |
| 5,607,982 | A | 3/1997 | Heyman et al. | |
| 6,099,954 | A | 8/2000 | Urbanavage et al. | |
| 6,107,355 | A | 8/2000 | Horn et al. | |
| 6,420,448 | B1 | 7/2002 | Hnatow et al. | |
| 6,803,495 | B2 | 10/2004 | Simpson | |
| 7,261,625 | B2 * | 8/2007 | Hishiki | 451/526 |
| 7,291,063 | B2 * | 11/2007 | Swisher et al. | 451/533 |
| 7,762,870 | B2 * | 7/2010 | Ono et al. | 451/28 |
| 7,927,452 | B2 * | 4/2011 | Hirose et al. | 156/307.1 |
| 2003/0109209 | A1 | 6/2003 | Hishiki | |
| 2004/0024719 | A1 | 2/2004 | Adar et al. | |
| 2004/0142641 | A1 | 7/2004 | Ohno et al. | |
| 2004/0166790 | A1 | 8/2004 | Balijepallie et al. | |

(Continued)

FOREIGN PATENT DOCUMENTS

| | | |
|---|---|---|
| CN | 1407606 | 4/2003 |

(Continued)

OTHER PUBLICATIONS

Japanese Office Action directed at counterpart application No. 2007-112032; 3 pages.

(Continued)

*Primary Examiner* — Dung Van Nguyen
(74) *Attorney, Agent, or Firm* — Morrison & Foerster LLP

(57) ABSTRACT

A polishing pad of excellent durability has a polishing layer is arranged on a base material layer, and the polishing layer comprises a thermosetting polyurethane foam having roughly spherical interconnected cells with an average cell diameter of 35 to 300 μm.

9 Claims, 2 Drawing Sheets

U.S. PATENT DOCUMENTS

| | | | | |
|---|---|---|---|---|
| 2005/0064709 | A1 | 3/2005 | Shimomura et al. | |
| 2005/0112354 | A1 | 5/2005 | Kume et al. | |
| 2005/0222288 | A1 | 10/2005 | Seyanagi et al. | |
| 2006/0022368 | A1 | 2/2006 | Lee et al. | |
| 2006/0280929 | A1 | 12/2006 | Shimomura et al. | |
| 2006/0280930 | A1 | 12/2006 | Shimomura et al. | |
| 2009/0011221 | A1 | 1/2009 | Kawaguchi et al. | |
| 2009/0093202 | A1 | 4/2009 | Fukuda et al. | |
| 2010/0003896 | A1 | 1/2010 | Nakai et al. | |
| 2010/0009611 | A1 | 1/2010 | Fukuda et al. | |
| 2010/0029185 | A1 * | 2/2010 | Fukuda et al. | 451/527 |
| 2010/0317263 | A1 | 12/2010 | Hirose et al. | |
| 2011/0151240 | A1 | 6/2011 | Hirose et al. | |

FOREIGN PATENT DOCUMENTS

| | | |
|---|---|---|
| CN | 1586002 | 2/2005 |
| CN | 1625575 | 6/2005 |
| JP | 60-042431 | 3/1985 |
| JP | 2-100321 | 4/1990 |
| JP | 4-159084 | 6/1992 |
| JP | 4-202215 | 7/1992 |
| JP | 5-329852 | 12/1993 |
| JP | 06-023664 | 2/1994 |
| JP | 6-262633 | 9/1994 |
| JP | 11-207758 | 8/1999 |
| JP | 2000-246620 | 9/2000 |
| JP | 2001-62703 | 3/2001 |
| JP | 2002-060452 | 2/2002 |
| JP | 2002-217149 | 8/2002 |
| JP | 2002-226608 | 8/2002 |
| JP | 2002-264912 | 9/2002 |
| JP | 2002-307293 | 10/2002 |
| JP | 2002-355754 | 12/2002 |
| JP | 2003-37089 | 2/2003 |
| JP | 2003-100681 | 4/2003 |
| JP | 2003-209079 | 7/2003 |
| JP | 2003-304951 | 10/2003 |
| JP | 2004-002788 | 1/2004 |
| JP | 3490431 | 1/2004 |
| JP | 2004-87647 | 3/2004 |
| JP | 2004-119657 | 4/2004 |
| JP | 2004-169038 | 6/2004 |
| JP | 2004-188716 | 7/2004 |
| JP | 2004-291155 | 10/2004 |
| JP | 2004-335713 | 11/2004 |
| JP | 2004-337992 | 12/2004 |
| JP | 2005-34971 | 2/2005 |
| JP | 2005-68175 | 3/2005 |
| JP | 2005-131720 | 5/2005 |
| JP | 2005-153053 | 6/2005 |
| JP | 2005-330621 | 12/2005 |
| JP | 2006-502300 | 1/2006 |
| JP | 2006-35367 | 2/2006 |
| JP | 2006-75914 | 3/2006 |
| JP | 2006-222349 | 8/2006 |
| JP | 2006-519115 | 8/2006 |
| JP | 2006-231429 | 9/2006 |
| JP | 2006-255828 | 9/2006 |
| JP | 2006-265303 | 10/2006 |
| JP | 2006-297515 | 11/2006 |
| JP | 2006-334745 | 12/2006 |
| JP | 2006-339570 | 12/2006 |
| JP | 2006-342191 | 12/2006 |
| JP | 2007-112032 | 5/2007 |
| JP | 2007-283712 | 11/2007 |
| JP | 2007-307700 | 11/2007 |
| JP | 2008-31034 | 2/2008 |
| JP | 2008-156519 | 7/2008 |
| TW | I222390 | 10/2004 |
| WO | WO-01/96434 | 12/2001 |
| WO | WO-2005/055693 | 6/2005 |
| WO | WO-2007/123168 | 11/2007 |
| WO | WO-2008/026451 | 3/2008 |

OTHER PUBLICATIONS

International Search Report mailed on Jun. 5, 2007 directed at counterpart application No. PCT/JP2007/058758; 1 page.

Taiwanese Office Action dated Aug. 20, 2009, directed towards corresponding Taiwanese Application No. 096114785; 9 Pages.

Korean Office Action dated Mar. 30, 2011, directed to corresponding Korean Application No. 10-2009-7004683; 7 pages.

International Search Report mailed Mar. 11, 2008, directed to International Application No. PCT/JP2007/072852; 4 pages.

International Search Report, mailed on Sep. 26, 2006, directed to International Patent Application No. PCT/JP2006/313597; 5 pages.

International Search Report mailed Jun. 2, 2009, directed to International Patent Application No. PCT/JP2009/053481; 3 pages.

Chinese Office Action mailed Dec. 18, 2009, directed to Chinese Patent Application No. 2006800259433; 11 pages.

Japanese Notification of Reasons for Refusal mailed Jul. 22, 2010, directed at foreign application No. JP-2008-063034; 6 pages.

Japanese Notification of Reasons for Refusal mailed Apr. 8, 2011 directed towards Japanese Patent Application No. 2006-072873; 6 pages.

Japanese Notification of Reasons for Refusal mailed Apr. 8, 2011 directed towards Japanese Patent Application No. 2006-072945; 6 pages.

Japanese Notification of Reasons for Refusal mailed Apr. 8, 2011 directed towards Japanese Patent Application No. 2006-072957; 6 pages.

Hirose, U.S. Office Action mailed May 4, 2010, directed to related U.S. Appl. No. 11/995,311; 9 pages.

Hirose et al., U.S. Office Action mailed Sep. 26, 2011, directed to U.S. Appl. No. 13/038,849; 11 pages.

Taiwanese Office Action mailed Sep. 7, 2011, directed to Taiwanese Application No. 096146036; 14 pages.

Fukuda, T. et al., U.S. Office Action mailed Nov. 16, 2011 directed to U.S. Appl. No. 12/519,339; 8 pages.

International Search Report mailed Jun. 5, 2007, directed to International Application No. PCT/JP2007/058757; 1 page.

Japanese Office Action mailed Jan. 22, 2009, directed to Japanese Application No. 2007-227773; 3 pages.

CN Office Action dated Apr. 22, 2010 directed to application No. 200780033122.9; 13 pages.

Taiwanese Office Action issued Oct. 28, 2010, directed to Taiwanese Application No. 096114786; 6 pages.

Korean Notice to Submit a Response dated Mar. 30, 2011, directed to Korean Application No. 10-2009-7004682; 6 pages.

Chinese Decision on Rejection dated Apr. 15, 2011, directed to Chinese Application No. 200780033122.9; 16 pages.

Malaysian Substantive Examination Adverse Report dated Dec. 15, 2011 directed to Malaysian Patent Application No. PI 20080065; 3 pages.

Fukuda et al., U.S. Office Action mailed Nov. 8, 2011, directed to U.S. Appl. No. 12/439,992; 11 pages.

Hirose, J. et al., U.S. Office Action mailed Feb. 7, 2012, directed to U.S. Appl. No. 13/038,849; 11 pages.

Chinese Notification of First Office Action dated Dec. 19, 2011, directed to Chinese Application No. 200910178369.0; 21 pages.

Japanese Notification of Reasons for Refusal mailed Jan. 10, 2012, directed to Japanese Application No. 2007-006229; 6 pages.

Japanese Notification of Reasons for Refusal mailed Feb. 2, 2012, directed to Japanese Application No. 2007-006224; 6 pages.

* cited by examiner

[Fig. 3]
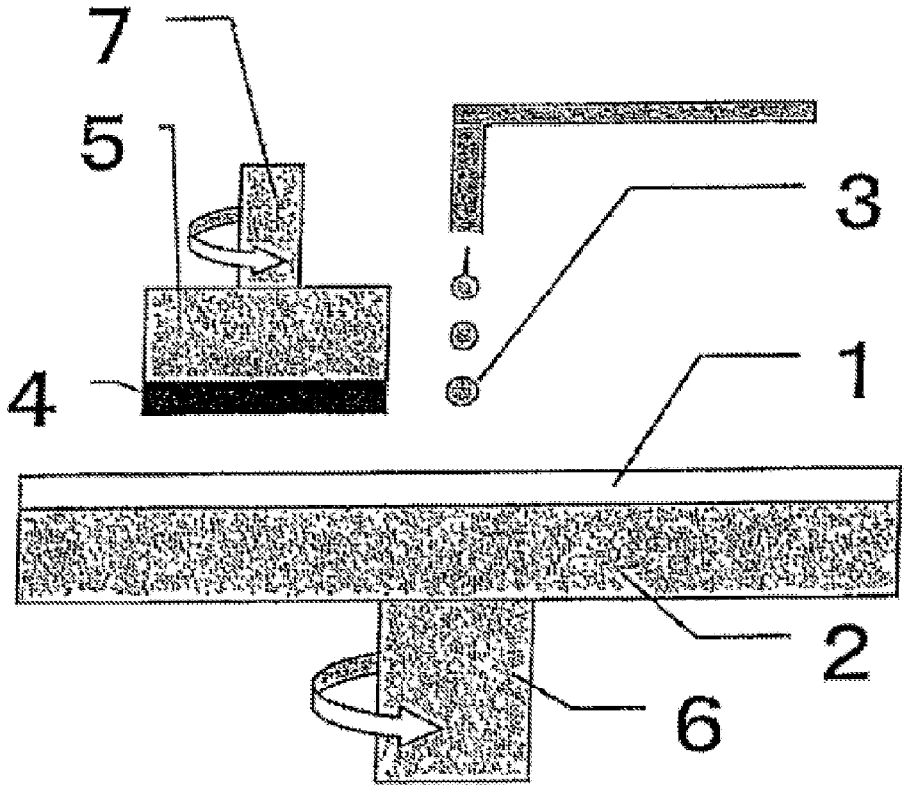

POLISHING PAD

REFERENCE TO RELATED APPLICATIONS

This application is a national stage application under 35 USC 371 of International Application No. PCT/JP2007/058758, filed Apr. 23, 2007, which claims the priority of Japanese Patent Application No. 2006-244418, filed Sep. 8, 2006, the contents of which prior applications are incorporated herein by reference.

FIELD OF THE INVENTION

The present invention relates to a polishing pad (for rough polishing or final polishing) used in polishing the surfaces of optical materials such as reflecting mirrors etc., silicon wafers, glass substrates for hard disks, aluminum substrates etc., as well as a method for manufacturing the polishing pad. Particularly, the polishing pad of the present invention is used preferably as a polishing pad for final polishing.

BACKGROUND OF THE INVENTION

Generally, the mirror polishing of semiconductor wafers such as a silicon wafer etc., lenses, and glass substrates includes rough polishing primarily intended to regulate planarity and in-plane uniformity and final polishing primarily intended to improve surface roughness and removal of scratches.

The final polishing is carried out usually by rubbing a wafer against an artificial suede made of flexible urethane foam stuck to a rotatable platen and simultaneously feeding thereon an abrasive containing a colloidal silica in an alkali-based aqueous solution (Patent Literature 1).

As the polishing pad for finishing used in final polishing, the following polishing pads have been proposed besides those described above.

A suede finishing polishing pad comprising a nap layer having a large number of long and thin holes (naps) formed with a foaming agent in the thickness direction, in polyurethane resin, and a foundation cloth for reinforcing the nap layer is proposed (Patent Literature 2).

A suede abrasive cloth for final polishing, in which surface roughness is expressed as an arithmetic average roughness (Ra) of 5 μm or less, is proposed (Patent Literature 3).

An abrasive cloth for final polishing, which is provided with a base material part and a surface layer (nap layer) formed on the base material part, wherein a polyvinyl halide or vinyl halide copolymer is contained in the surface layer, is proposed (Patent Literature 4).

Conventional polishing pads for finishing have been produced by a wet curing method. The wet curing method is a method wherein an urethane resin solution obtained by dissolving urethane resin in a water-soluble organic solvent such as dimethylformamide is applied onto a base material, then wet-solidified by treatment in water, to form a porous grain side layer, which is then washed with water and dried, followed by polishing of the grain side layer to form a surface layer (nap layer). In Patent Literature 5, for example, an abrasive cloth for finishing, having roughly spherical holes having an average particle diameter of 1 to 30 μm, is produced by the wet curing method.

In the conventional polishing pads for finishing, however, cells have a thin and long structure, or a material of the surface layer itself is poor in mechanical strength, and thus there are problems such as poor durability, gradual deterioration in planarizing characteristics, and inferior stability of removal rate.

Patent Literature 1: JP-A 2003-37089
Patent Literature 2: JP-A 2003-100681
Patent Literature 3: JP-A 2004-291155
Patent Literature 4: JP-A 2004-335713
Patent Literature 5: JP-A 2006-75914

SUMMARY OF THE INVENTION

An object of the present invention is to provide a polishing pad excellent in durability.

The present inventors made extensive study to solve the problem described above, and as a result, they found that the object can be achieved by the following polishing pad and reached completion of the present invention.

That is, the present invention relates to a polishing pad, wherein a polishing layer is arranged on a base material layer, and the polishing layer comprises a thermosetting polyurethane foam having roughly spherical interconnected cells with an average cell diameter of 35 to 300 μm.

It is believed that the conventional polishing pads for finishing, upon repeated application of pressure to the polishing layer, are liable to "collapse" and are poor in durability because cells of the polishing pads have a thin and long structure or the material of the polishing layer itself is poor in mechanical strength. On the other hand, when a thermosetting polyurethane foam having roughly spherical interconnected cells having an average cell diameter of 35 to 300 μm is used to form a polishing layer as described above, the durability of the polishing layer can be improved. Accordingly, when the polishing pad of the present invention is used, planarizing characteristics can be kept high for a long period of time, and the stability of a removal rate can be also improved. The term "roughly spherical" refers to sphere-shaped and oval sphere-shaped. Oval sphere-shaped cells are those having a ratio of a major axis L/minor axis S (L/S) of 5 or less, preferably 3 or less, more preferably 1.5 or less.

The thermosetting polyurethane foam of the present invention has an interconnected cell structure, has microscopic holes formed on the surfaces of cells and thus has suitable water retention characteristics.

Preferably, the thermosetting polyurethane foam had self-adhered to a base material layer. Release of the polishing layer from the base material layer can thereby be effectively prevented.

The base material layer is preferably a foamed plastic film containing at least one resin selected from the group consisting of polyethylene, polypropylene and polyurethane. In CMP, both a polishing pad and an object to be polished such as a wafer are rotated and revolved and rubbed against each other under pressure thereby executing polishing. During polishing, the polishing pad is subjected to various strengths (particularly in the horizontal direction) and is thus easily deformed, which may result in uneven polishing and scratching of the object to be polished. By using the base material layer made of the above-mentioned foamed plastic film, the base material layer can be prevented from being expanded and contracted during polishing, thereby deformation of the polishing pad can be suppressed.

A thickness of the base material layer is preferably 20 to 1000 μm. When the thickness is less than 20 μm, the polishing pad is insufficient in strength and tends to be easily deformed. On the other hand, when the thickness is greater than 1000 μm, flexibility tends to be lacking.

The present invention also relates to a method for manufacturing a semiconductor device, which comprises a step of polishing the surface of a semiconductor wafer with the polishing pad described above.

BRIEF DESCRIPTION OF DRAWINGS

FIG. 3 is a schematic illustration showing one example of a conventional polishing apparatus used in CMP polishing.

DETAILED DESCRIPTION OF THE INVENTION

Figure 1:
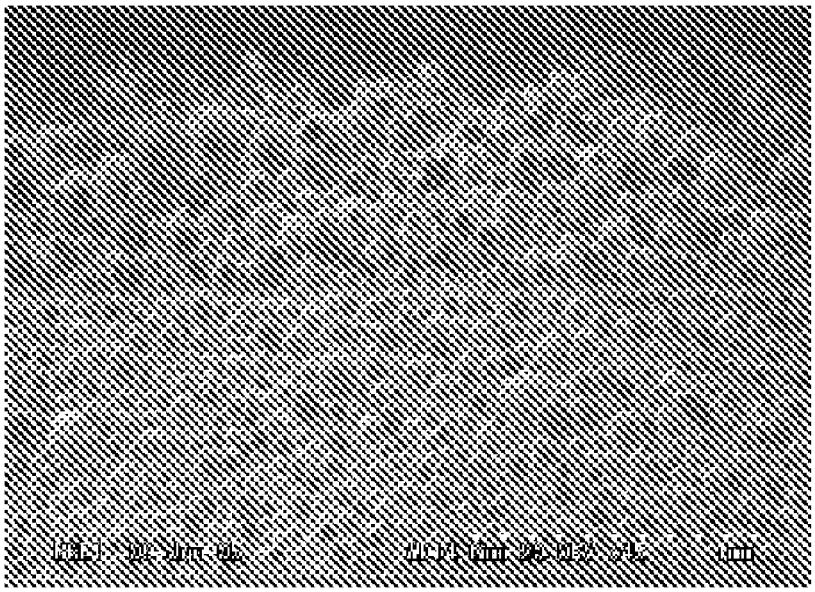
FIG. 1 is a photomicrograph (SEM photograph) of the polishing pad in Example 1.

The polishing pad of the present invention comprises a base material layer and a polishing layer made of a thermosetting polyurethane foam (hereinafter referred to as polyurethane foam) having roughly spherical interconnected cells having an average cell diameter of 35 to 300 μm.

The polyurethane resin is a preferable material for forming the polishing layer because it is excellent in abrasion resistance, a polyurethane polymer having desired physical properties can be easily obtained by changing its raw material composition, and roughly spherical fine cells can be easily formed by a mechanical foaming method (including a mechanical frothing method).

The polyurethane resin comprises an isocyanate component, a polyol component (high-molecular-weight polyol, low-molecular-weight polyol etc.) and a chain extender.

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, polymeric MDI, carbodiimide modified MDI (for example, Millionate MTL made by Nippon Polyurethane Industry Co., Ltd.), 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and cycloaliphatic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof.

As the isocyanate component, it is possible to use not only the above-described diisocyanate compounds but also multifunctional (trifunctional or more) polyisocyanates. As the multifunctional isocyanate compounds, a series of diisocyanate adduct compounds are commercially available as Desmodul-N (Bayer) and Duranate™ (Asahi Chemical Industry Co., Ltd.).

Among the isocyanate components described above, 4,4'-diphenylmethane diisocyanate or carbodiimide modified MDI is preferably used.

As the high-molecular-weight polyol, a compound known in the field of polyurethane can be used without particular limitation. The high-molecular-weight polyol includes, for example, polyether polyols represented by polytetramethylene ether glycol and polyethylene glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, polycarbonate polyols obtained by ester exchange reaction of a polyhydroxyl compound with aryl carbonate, and polymer polyols such as polyether polyol in which polymer particles are dispersed. These may be used singly or as a mixture of two or more thereof.

To produce the polyurethane foam having an interconnected cell structure, a polymer polyol is preferably used, and a polymer polyol in which polymer particles made of acrylonitrile and/or styrene-acrylonitrile copolymers are dispersed is particularly preferably used. This polymer polyol is contained in an amount of preferably 20 to 100 wt %, more preferably 30 to 60 wt %, in the whole polymer polyol used. The high-molecular-weight polyol (including the polymer polyol) is contained in an amount of 60 to 85 wt %, more preferably 70 to 80 wt %, in the active hydrogen-containing compound. By using the high-molecular-weight polyol in a specified amount, cell films are easily broken to easily form an interconnected cell structure.

Among the high-molecular-weight polyols, a high-molecular-weight polyol having a hydroxyl value of 20 to 100 mg KOH/g is preferably used. The hydroxyl value is more preferably 25 to 60 mg KOH/g. When the hydroxyl value is less than 20 mg KOH/g, an amount of a hard segment in the polyurethane is reduced so that durability tends to be reduced, while when the hydroxyl value is greater than 100 mg KOH/g, a crosslinking degree of the polyurethane foam becomes so high that the product tends to be brittle.

A number-average molecular weight of the high-molecular-weight polyol is not particularly limited, but is preferably 1500 to 6000, from the viewpoint of the elastic characteristics of the resulting polyurethane. When the number-average molecular weight is less than 1500, the polyurethane obtained therefrom does not have sufficient elastic characteristics, thus easily becoming a brittle polymer. Accordingly, a polishing layer made of this polyurethane foam is rigid to easily cause scratch of the polished surface of an object to be polished. On the other hand, when the number-average molecular weight is higher than 6000, polyurethane obtained therefrom becomes too soft. Therefore, a polishing pad made of this polyurethane foam tends to be inferior in durability.

Examples of the low-molecular-weight polyol that can be used together with a high-molecular-weight polyol described above include: ethylene glycol, 1,2-propylene glycol, 1,3-propylene glycol, 1,2-butanediol, 1,3-butanediol, 1,4-butanediol, 2,3-butanediol, 1,6-hexanediol, neopentyl glycol, 1,4-cyclohexanedimethanol, 3-methyl-1,5-pentanediol, diethylene glycol, triethyleneglycol, 1,4-bis(2-hydroxyethoxy)benzene, trimethylolpropane, glycerin, 1,2,6-hexanetriol, pentaerythritol, tetramethylolcyclohexane, methyl glucoside, sorbitol, mannitol, dulcitol, sucrose, 2,2,6,6-tetrakis(hydroxymethyl)cyclohexanol, diethanolamine, N-methyldiethanolamine, triethanolamine and the like. Other examples that can be used together with the high-molecular-weight polyol also include: low-molecular-weight polyamine such as ethylenediamine, tolylenediamine, diphenylmethanediamine, diethylenetriamine and the like. Still other examples that can be used together with the high-molecular-weight polyol also include: alcoholamines such as monoethanolamine, 2-(2-aminoethylamino) ethanol, monopropanolamine and the like. These low-molecular-weight polyols, high-molecular-weight polyamines etc. may be used alone or as a mixture of two or more thereof.

Among these compounds, a low-molecular-weight polyol having a hydroxyl value of 400 to 1830 mg KOH/g and/or a low-molecular-weight polyamine having an amine value of 400 to 1870 mg KOH/g are preferably used. The hydroxyl value is more preferably 700 to 1250 mg KOH/g, and the amine value is more preferably 400 to 950 mg KOH/g. When the hydroxyl value is less than 400 mg KOH/g or the amine value is less than 400 mg KOH/g, an effect of improving formation of interconnected cells tends to be not sufficiently obtained. On the other hand, when the hydroxyl value is greater than 1830 mg KOH/g or the amine value is greater than 1870 mg KOH/g, a wafer tends to be easily scratched on the surface. Particularly, diethylene glycol, triethylene glycol or 1,4-butanediol is preferably used.

To form the polyurethane foam having an interconnected cell structure, the low-molecular-weight polyol, the low-molecular-weight polyamine and the alcohol amine are contained in the total amount of preferably 2 to 15 wt %, more preferably 5 to 10 wt %, in the active hydrogen-containing compound. By using the low-molecular-weight polyol etc. in specified amounts, cell films are easily broken to easily form an interconnected cell structure and further the mechanical characteristics of the polyurethane foam are improved.

In the case where a polyurethane foam is produced by means of a prepolymer method, a chain extender is used in curing of a prepolymer. A chain extender is an organic compound having at least two active hydrogen groups and examples of the active hydrogen group include: a hydroxyl group, a primary or secondary amino group, a thiol group (SH) and the like. Concrete examples of the chain extender include: polyamines such as 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethylene oxide-di-p-aminobenzoate, 4,4'-diamino-3,3',5,5'-tetraethyldiphenylmethane, 4,4'-diamino-3,3'-diisopropyl-5,5'-dimethyldiphenylmethane, 4,4'-diamino-3,3',5,5'-tetraisopropyldiphenylmethane, 1,2-bis(2-aminophenylthio) ethane, 4,4'-diamino-3,3'-diethyl-5,5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; low-molecular-weight polyol component; and a low-molecular-weight polyamine component. The chain extenders described above may be used either alone or in mixture of two kinds or more.

A ratio between an isocyanate component, a polyol component and a chain extender in the invention can be altered in various ways according to molecular weights thereof, desired physical properties of polyurethane foam and the like. In order to obtain polyurethane foam with desired polishing characteristics, a ratio of the number of isocyanate groups in an isocyanate component relative to a total number of active hydrogen groups (hydroxyl groups+amino groups) in a polyol component and a chain extender is preferably in the range of from 0.80 to 1.20 and more preferably in the range of from 0.99 to 1.15. When the number of isocyanate groups is outside the aforementioned range, there is a tendency that curing deficiency is caused, required specific gravity and hardness are not obtained, and polishing property is deteriorated.

A polyurethane resin can be produced by applying a melting method, a solution method or a known polymerization technique, among which preferable is a melting method, consideration being given to a cost, a working environment and the like.

Manufacture of a polyurethane resin is enabled by means of either a prepolymer method or a one shot method, of which preferable is a prepolymer method in which an isocyanate-terminated prepolymer is synthesized from an isocyanate component and a polyol component in advance, with which a chain extender is reacted since physical properties of an obtained polyurethane resin is excellent.

Note that an isocyanate-terminated prepolymer with a molecular weight of the order in the range of from 800 to 5000 is preferable because of excellency in workability and physical properties.

Manufacture of the polyurethane resin is to mix the first component containing an isocyanate group containing compound and the second component containing an active hydrogen group containing compound to thereby cure the reaction product. In the prepolymer method, an isocyanate-terminated prepolymer serves as an isocyanate group containing compound and a chain extender serves as an active hydrogen group containing compound. In the one shot method, an isocyanate component serves as an isocyanate group containing compound, and a chain extender and a polyol component combined serves as an active hydrogen containing compound.

The polyurethane foam as the material for forming the polishing layer in the present invention can be produced by a mechanical foaming method (including a mechanical frothing method).

Particularly, a mechanical foaming method using a silicone-based surfactant which is a copolymer of polyalkylsiloxane and polyether is preferable. As such the silicone-based surfactant, SH-192 and L-5340 (manufactured by Toray Dow Corning Silicone Co., Ltd.) etc. are exemplified as a suitable compound.

Various additives may be mixed; such as a stabilizer including an antioxidant, a lubricant, a pigment, a filler, an antistatic agent and others.

Description will be given of an example of a method of producing a polyurethane foam constituting a polishing layer below. A method of manufacturing such a polyurethane foam has the following steps.

(1) The first component wherein a silicon-based surfactant is added to an isocyanate-terminated prepolymer produced by an isocyanate component with a high-molecular-weight polyol or the like is mechanically stirred in the presence of an unreactive gas, to disperse the unreactive gas as fine cells thereby forming a cell dispersion. Then, the second component containing active hydrogen-containing compounds such as high-molecular-weight and low-molecular-weight polyols are added to, and mixed with, the cell dispersion to prepare a cell dispersed urethane composition. If necessary, a catalyst may be added to the second component.

(2) A silicon-based surfactant is added to the first component containing an isocyanate component (or an isocyanate-terminated prepolymer) and/or the second component containing active hydrogen-containing compounds, and the component (s) to which the silicon-based surfactant is added is mechanically stirred in the presence of an unreactive gas, to disperse the unreactive gas as fine cells thereby forming a cell dispersion. Then, the remaining component is added to, and mixed with, the cell dispersion to prepare a cell dispersed urethane composition.

(3) A silicon-based surfactant is added to at least either of the first component containing an isocyanate component (or an isocyanate-terminated prepolymer) or the second component containing active hydrogen-containing compounds, and the first and second components are mechanically stirred in the presence of an unreactive gas, to disperse the unreactive gas as fine cells thereby preparing a cell dispersed urethane composition.

Alternatively, the cell dispersed urethane composition may be prepared by a mechanical frothing method. The mechanical frothing method is a method wherein starting components are introduced into a mixing chamber, while an unreactive gas is mixed therein, and the mixture is mixed under stirring with a mixer such as an Oaks mixer thereby dispersing the unreactive gas in a fine-cell state in the starting mixture. The mechanical frothing method is a preferable method because a density of the polyurethane foam can be easily adjusted by regulating the amount of an unreactive gas mixed therein. In addition, the efficiency of production is high because the polyurethane foam having fine cells with an average cell diameter of 35 to 300 μm can be continuously formed.

Thereafter, the cell dispersed urethane composition is poured into a mold (pouring process) and reacted and cured by heating (curing process).

The unreactive gas used for forming fine bubbles is preferably not combustible, and is specifically nitrogen, oxygen, a carbon dioxide gas, a rare gas such as helium and argon, and a mixed gas thereof, and the air dried to remove water is most preferable in respect of cost.

As a stirring device for dispersing an unreactive gas in a fine-cell state, any known stirring deices can be used without particular limitation, and specific examples include a homogenizer, a dissolver, a twin-screw planetary mixer, a mechanical froth foaming machine etc. The shape of a stirring blade of the stirring device is not particularly limited, and a whipper-type stirring blade is preferably used to form fine cells. For obtaining the intended polyurethane foam, the number of revolutions of the stirring blade is preferably 500 to 2000 rpm, more preferably 800 to 1500 rpm. The stirring time is suitably regulated depending on the intended density.

In a preferable mode, different stirring devices are used for preparing a cell dispersion in the foaming process and for stirring the first and the second components to mix them, respectively. Stirring in the mixing step may not be stirring for forming cells, and a stirring device not generating large cells is preferably used in the mixing step. Such a stirring device is preferably a planetary mixer. The same stirring device may be used in the foaming step of preparing a cell dispersion and in the mixing step of mixing the respective components, and stirring conditions such as a revolution rate of the stirring blade are preferably regulated according to necessary.

In the method of producing the polyurethane foam, heating and post-curing of the foam obtained after casting and reacting the cell dispersed urethane composition in a mold until the dispersion lost fluidity are effective in improving the physical properties of the foam, and are extremely preferable. The cell dispersed urethane composition may be cast in a mold and immediately post-cured in a heating oven, and even under such conditions, heat is not immediately conducted to the reactive components, and thus the diameters of cells are not increased. The curing reaction is conducted preferably at normal pressures to stabilize the shape of cells.

In the production of the polyurethane foam, a known catalyst promoting polyurethane reaction, such as tertiary amine-based catalysts, may be used. The type and amount of the catalyst added are determined in consideration of flow time in casting in a predetermined mold after the mixing step.

Alternatively, the cell dispersed urethane composition is poured into a mold of predetermined size to prepare a block, and the block is sliced with a hook- or handsaw-shaped slicer, or before the stage of pouring, the cell dispersed urethane composition may be formed into a thin sheet. For preventing fluctuation in a thickness of the polishing layer, the surface of the sheet-shaped polyurethane foam is preferably buffed.

The base material layer is not particularly limited, and examples include a foamed plastic film of polyethylene, polypropylene or polyurethane, a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, a rubber-like resin such as butadiene rubber and isoprene rubber, and a photosensitive resin. Among these materials, a foamed plastic film containing at least one resin selected from the group consisting of polyethylene, polypropylene and polyurethane is preferably used.

Preferably, the base material layer has hardness equal to or higher than that of the polyurethane foam in order to confer toughness on the polishing pad for finishing. The thickness of the base material layer is not particularly limited, but from the viewpoint of strength, pliability etc., the thickness is preferably 20 to 1000 μm, more preferably 50 to 800 μm.

Means for adhering the polishing layer made of the polyurethane foam to the base material layer include: for example, a method in which a double sided tape is sandwiched between the polishing layer and the base material layer, followed by pressing.

The double sided tape is of a common construction in which adhesive layers are provided on both surfaces of a substrate such as a nonwoven fabric or a film. It is preferable to use a film as a substrate with consideration given to prevention of permeation of a slurry into the base material layer. A composition of an adhesive layer is, for example, of a rubber-based adhesive, an acrylic-based adhesive or the like.

In the present invention, it is preferable that the cell dispersed urethane composition prepared by the method described above is applied onto the base material layer, and then the cell dispersed urethane composition is cured to directly form a polyurethane foam (polishing layer) on the base material layer.

A method of applying the cell dispersed urethane composition onto the base material layer can make use of coating methods using, for example, roll coaters such as a gravure coater, kiss-roll coater and comma coater, die coaters such as a slot coater and fountain coater, and a squeeze coater, a curtain coater etc., and any methods can be used insofar as a uniform coating film can be formed on the base material layer.

Post cure by heating the polyurethane foam, formed by applying the cell dispersed urethane composition onto the base material layer and then reacting the composition until it does not flow, has an effect of improving physical properties of the polyurethane foam and is thus extremely preferable. Post cure is carried out preferably at 40 to 70° C. for 10 to 60 minutes and conducted preferably at a normal pressure in order to stabilize the shape of cells.

Production of the polishing pad of the present invention may be carried out in a batch system wherein the respective components are weighed, introduced into a container, and mechanically stirred, or in a continuous production system wherein the respective components and an unreactive gas are continuously fed to a stirring device and mechanically stirred, and the resulting cell dispersed urethane composition is sent onto a base material layer to form a product.

Preferably, a thickness of the polyurethane foam is uniformly regulated after the polyurethane foam is formed on the base material layer or while the polyurethane foam is formed. A method of uniformly regulating the thickness of the polyurethane foam includes, but is not limited to, a method of buffing the polyurethane foam with an abrasive, a method of pressing it with a pressing plate, etc.

On the other hand, the cell dispersed urethane composition prepared by the method described above is applied onto the base material layer, and a release sheet is laminated on the cell dispersed urethane composition. Thereafter, the cell dispersed urethane composition may be cured to form a polyurethane foam while the thickness thereof is made uniform with a pressing means.

A material for forming the release sheet includes, but is not limited to, general resin and paper. The release sheet is preferably a sheet with less dimensional change upon heating. The surface of the release sheet may be subjected to a release treatment.

A pressing means for pressing a sandwich sheet made of the base material layer, the cell dispersed urethane composition (cell dispersed urethane layer) and the release sheet to make the thickness of the sandwich sheet uniform is not particularly limited, and for example, a method of pressing it to a predetermined thickness with a coater roll, a nip roll or the like. In considering the fact that, after compression, the size of cells in the foam is increased about 1.2 to 2 times, it is preferable in compression to satisfy the following equation: (Clearance of a coater or nip)−(thickness of the base material layer and release sheet)=(50 to 85% of the thickness of the polyurethane foam after curing).

After the thickness of the sandwich sheet is made uniform, the polyurethane foam is reacted until it does not flow, followed by post cure to form a polishing layer. The conditions for post cure are the same as described above.

Thereafter, a polishing pad is obtained by releasing the release sheet from the polyurethane foam. In this case, a skin layer is formed on the polyurethane foam, and thus the skin layer is removed by buffing or the like.

A shape of the polishing pad of the present invention is not particularly limited, and may be a lengthy form with a length of about several meters or a round form with a diameter of several dozen centimeters.

An average cell diameter of the polyurethane foam is necessary to be 35 to 300 μm and is preferably 35 to 100 μm, more preferably 40 to 80 μm. When the average cell diameter deviates from this range, a removal rate decreases and durability is reduced.

A specific gravity of the polyurethane foam is preferably 0.2 to 0.5. When the specific gravity is less than 0.2, durability of the polishing layer tends to be reduced. When the specific gravity is greater than 0.5, the crosslink density of the material should be lowered to attain a certain modulus of elasticity. In this case, permanent deformation tends to be increased and durability tends to be deteriorated.

A hardness of the polyurethane foam, as determined by an Asker C hardness meter, is preferably 10 to 50 degrees, more preferably 15 to 35 degrees. When the Asker C hardness is less than 10 degrees, the durability of the polishing layer is reduced, and the surface smoothness of an object to be polished after polishing tends to be deteriorated. When the hardness is greater than 50 degrees, on the other hand, the object to be polished is easily scratched on the surface.

A polishing layer is preferably provided with a depression and a protrusion structure for holding and renewing a slurry. Though in a case where the polishing layer is formed with a fine foam, many openings are on a polishing surface thereof which works so as to hold the slurry, a depression and protrusion structure are preferably provided on the surface of the polishing side thereof in order to achieve more of holdability and renewal of the slurry or in order to prevent induction of dechuck error, breakage of a wafer or decrease in polishing efficiency. The shape of the depression and protrusion structure is not particularly limited insofar as slurry can be retained and renewed, and examples include latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These depression and protrusion structure are generally those having regularity, but the groove pitch, groove width, groove depth etc. can also be changed at each certain region to make retention and renewal of slurry desirable.

The method of forming the depression and protrusion structure is not particularly limited, and for example, formation by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like.

No specific limitation is placed on a thickness of a polishing layer, but a thickness thereof is about 0.2 to 1.2 mm, preferably 0.3 to 0.8 mm.

A polishing pad of the invention may be provided with a double sided tape on the surface of the pad adhered to a platen.

A semiconductor device is fabricated after operation in a step of polishing a surface of a semiconductor wafer with a polishing pad. The term, a semiconductor wafer, generally means a silicon wafer on which a wiring metal and an oxide layer are stacked. No specific limitation is imposed on a polishing method of a semiconductor wafer or a polishing apparatus, and polishing is performed with a polishing apparatus equipped, as shown in FIG. 3, with a polishing platen 2 supporting a polishing pad (a polishing layer) 1, a polishing head 5 holding a semiconductor wafer 4, a backing material for applying a uniform pressure against the wafer and a supply mechanism of a polishing agent 3. The polishing pad 1 is mounted on the polishing platen 2 by adhering the pad to the platen with a double sided tape. The polishing platen 2 and the polishing head 5 are disposed so that the polishing pad 1 and the semiconductor wafer 4 supported or held by them oppositely face each other and provided with respective rotary shafts 6 and 7. A pressure mechanism for pressing the semiconductor wafer 4 to the polishing pad 1 is installed on the polishing head 5 side. During polishing, the semiconductor wafer 4 is polished by being pressed against the polishing pad 1 while the polishing platen 2 and the polishing head 5 are rotated and a slurry is fed. No specific limitation is placed on a flow rate of the slurry, a polishing load, a polishing platen rotation number and a wafer rotation number, which are properly adjusted.

Protrusions and scratches on the surface of the semiconductor wafer 4 are thereby removed and polished flatly. Thereafter, a semiconductor device is produced therefrom through dicing, bonding, packaging etc. The semiconductor device is used in an arithmetic processor, a memory etc. Lenses, or glass substrates for hard disks, can also be subjected to final polishing in the same manner as described above.

EXAMPLES

Description will be given of the invention with examples, while the invention is not limited to description in the examples.

[Measurement and Evaluation Method]

(Measurement of Average Cell Diameter)

The prepared polyurethane foam was sliced with a microtome cutter into measurement samples each with the thinnest possible thickness of 1 mm or less. A surface of a sample was photographed with a scanning electron microscope (manufactured by Hitachi Science System Co. with a model number of S-3500N) at a magnification of ×200. An effective circular diameter of each of all cells in an arbitrary area was measured with an image analyzing soft (manufactured by MITANI Corp. with a trade name WIN-ROOF) and an average cell diameter was calculated from the measured values. In the case of an oval sphere-shaped cell, its cell diameter was expressed as the diameter of a circular cell equivalent in area to the oval sphere-shaped cell.

(Measurement of Specific Gravity)

Determined according to JIS Z8807-1976. The prepared polyurethane foam cut out in the form of a strip of 4 cm×8.5 cm (thickness: arbitrary) was used as a sample for measurement of specific gravity and left for 16 hours in an environment of a temperature of 23±2° C. and a humidity of 50%±5%. Measurement was conducted by using a specific gravity hydrometer (manufactured by Sartorius Co., Ltd).

(Measurement of Hardness)

A hardness was measured in accordance with JIS K-7312. The prepared polyurethane foam was cut into samples with a size of 5 cm×5 cm (with arbitrary thickness), and the samples were left for 16 hours in an environment at a temperature of 23° C.±2° C. and humidity of 50%±5%. When measured, the samples were piled up to a thickness of 10 mm or more. A hardness meter (Asker C hardness meter, pressurized surface height 3 mm, manufactured by Kobunshi Keiki Co., Ltd.) was contacted with a pressurized surface, and 30 seconds later, the hardness was measured.

(Evaluation of Removal Rate Stability)

As a polishing device, SPP600S (manufactured by Okamoto Machine Tool Works, Ltd.) was used to evaluate the removal rate stability of the prepared polishing pad. The evaluation results are shown in Table 1. The polishing conditions are as follows:

Glass plate: 6 inches ϕ, thickness 1.1 mm (optical glass, BK7)
Slurry: Ceria slurry (Showa Denko GPL C1010)
Slurry amount: 100 ml/min
Polishing pressure: 10 kPa
Number of revolutions of polishing platen: 55 rpm
Number of revolutions of glass plate: 50 rpm
Polishing time: 10 min/plate
Number of glass plates polished: 500

First, the removal rate (Å/min) for each of polished glass plates is calculated. The calculation method is as follows: Removal rate=[amount of change [g] of glass plate before and after polishing/(glass plate density [g/cm$^3$]×polished area [cm$^2$] of glass plate×polishing time [min])]×10$^8$ A removal rate stability (%) is calculated by determining the maximum removal rate, minimum removal rate and average removal rate of from a first glass plate to a final treated glass plate (100 plates, 300 plates or 500 plates in total) and then substituting the above values in the following equation. A lower removal rate stability (%) is indicative of less change in removal rate even when a large number of glass plates are polished. In the present invention, it is preferable that the removal rate stability after treatment of 500 plates is within 10%. Removal rate stability (%)=[(maximum removal rate−minimum removal rate)/average removal rate of all glass plates]×100

Example 1

45 parts by weight of POP36/28 (polymer polyol, hydroxyl value 28 mg KOH/g, made by Mitsui Chemicals, Inc.), 40 parts by weight of ED-37A (polyether polyol, hydroxyl value 38 mg KOH/g, made by Mitsui Chemicals, Inc.), 10 parts by weight of PLC305 (polyester polyol, hydroxyl value 305 mg KOH/g, made by Daicel Chemical Industries, Ltd.), 5 parts by weight of diethylene glycol, 5.5 parts by weight of a silicon-based surfactant (SH-192, made by Toray Dow Corning Silicone Co., Ltd.) and 0.25 part by weight of a catalyst (No. 25, made by Kao Corporation) were introduced into a container and sufficiently mixed. Then, the mixture was stirred vigorously for about 4 minutes at a revolution number of 900 rpm by a stirring blade so as to incorporate bubbles into the reaction system. Thereafter, 31.57 parts by weight of Millionate MTL (made by Nippon Polyurethane Industry Co., Ltd.) were added thereto and stirred for about 1 minute to prepare a cell dispersed urethane composition A.

The prepared cell dispersed urethane dispersion composition A was applied onto a base material layer (trade name: Pef, a polyethylene foam with a specific gravity of 0.18 and an Asker C hardness of 50, made by Toray) previously regulated by buffing to have a thickness of 0.8 mm, to prepare a cell dispersed urethane layer thereon. Then, the cell dispersed urethane layer was covered with a release sheet (polyethylene terephthalate, thickness 0.2 mm) previously subjected to release treatment. The cell dispersed urethane layer was regulated to be 1.0 mm in thickness with a nip roll and then cured at 70° C. for 40 minutes to form a polyurethane foam (average cell diameter, 70 μm; mean major axis/mean minor axis=1.3; specific gravity, 0.34; C hardness, 23 degrees). Thereafter, the release sheet on the polyurethane foam was released. Then, the surface of the polyurethane foam was buffed to a thickness of 0.8 mm by a buffing machine (manufactured by Amitec) to give a foam having regulated thickness accuracy. Thereafter, a double-sided tape (double tack tape manufactured by Sekisui Chemical Co., Ltd) was stuck by a laminator to the surface of the base material layer to prepare a polishing pad. FIG. 1 shows a photomicrograph of a cross section of the polishing pad. It can be seen that roughly spherical interconnected cells are formed in the polyurethane foam.

Example 2

POP36/28 (45 parts by weight), ED-37A (37.5 parts by weight), PCL305 (10 parts by weight), 7.5 parts by weight of diethylene glycol, SH-192 (5.6 parts by weight), 0.5 part by weight of carbon black, and 0.22 part by weight of a catalyst (No. 25) were introduced into a container and mixed. Then, the mixture was stirred vigorously for about 4 minutes at a revolution number of 900 rpm by a stirring blade so as to incorporate bubbles into the reaction system. Thereafter, Millionate MTL (38.8 parts by weight) were added thereto and stirred for about 1 minute to prepare a cell dispersed urethane composition B.

A polishing pad was prepared in the same manner as in Example 1 except that the cell dispersed urethane composition B was used in place of the cell dispersed urethane composition A. When a section of the polishing pad was observed under a microscope, roughly spherical interconnected cells had been formed in the polyurethane foam (average cell diameter, 66 μm; mean major axis/mean minor axis=1.4; specific gravity, 0.35; C hardness, 29 degrees).

Example 3

POP36/28 (45 parts by weight), ED-37A (35 parts by weight), PCL305 (10 parts by weight), 10 parts by weight of diethylene glycol, SH-192 (6.2 parts by weight), 0.5 part by weight of carbon black, and 0.2 part by weight of a catalyst (No. 25) were introduced into a container and mixed. Then, the mixture was stirred vigorously for about 4 minutes at a revolution number of 900 rpm by a stirring blade so as to incorporate bubbles into the reaction system. Thereafter, Millionate MTL (46.04 parts by weight) were added thereto and stirred for about 1 minute to prepare a cell dispersed urethane composition C.

A polishing pad was prepared in the same manner as in Example 1 except that the cell dispersed urethane composition C was used in place of the cell dispersed urethane composition A. When a section of the polishing pad was observed under a microscope, roughly spherical interconnected cells had been formed in the polyurethane foam (average cell diameter, 75 μm; mean major axis/mean minor axis=1.3; specific gravity, 0.35; C hardness, 32 degrees).

Example 4

POP36/28 (45 parts by weight), ED-37A (30 parts by weight), PCL305 (10 parts by weight), 15 parts by weight of diethylene glycol, SH-192 (6.6 parts by weight), 0.5 part by weight of carbon black, and 0.15 part by weight of a catalyst (No. 25) were introduced into a container and mixed. Then, the mixture was stirred vigorously for about 4 minutes at a revolution number of 900 rpm by a stirring blade so as to incorporate bubbles into the reaction system. Thereafter, Millionate MTL (60.51 parts by weight) were added thereto and stirred for about 1 minute to prepare a cell dispersed urethane composition D.

A polishing pad was prepared in the same manner as in Example 1 except that the cell dispersed urethane composition D was used in place of the cell dispersed urethane composition A. When a section of the polishing pad was observed under a microscope, roughly spherical interconnected cells had been formed in the polyurethane foam (average cell diameter, 78 μm; mean major axis/mean minor axis=1.3; specific gravity, 0.35; C hardness, 31 degrees).

Comparative Example 1

Figure 2:
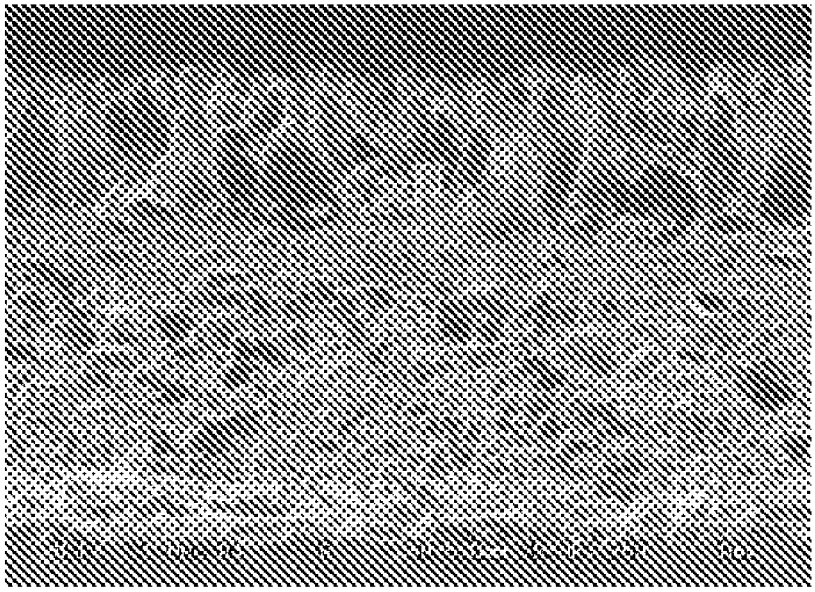
FIG. 2 is a photomicrograph (SEM photograph) of the polishing pad in Comparative Example 1.

10 parts by weight of thermoplastic urethane (Rezamine 7285, made by Dainichiseika Colour & Chemicals Mfg. Co., Ltd.) were dissolved in 90 parts by weight of dimethylformamide to prepare an urethane solution. The urethane solution was applied onto a base material layer (Bolance 4211N, Asker C hardness 22 degrees, made by Toyobo Co., Ltd.) previously regulated by buffing to have a thickness of 0.8 mm, to prepare an urethane film thereon. Thereafter, the urethane film-base material layer was dipped in a DMF-water mixture (DMF/water=30/70) for 30 minutes and then dipped in water for 24 hours to replace the dimethylformamide by water, whereby a polyurethane foam (specific gravity, 0.26; C hardness, 27 degrees) was formed. Then, the surface of the polyurethane foam was buffed to a thickness of 0.8 mm by a buffing machine to give a foam having regulated thickness accuracy. Thereafter, a double-sided tape (double tack tape manufactured by Sekisui Chemical Co., Ltd) was stuck by a laminator to the surface of the base material layer to prepare a polishing pad. FIG. 2 shows a photomicrograph of a cross section of the polishing pad. It can be seen that thin and long drop-shaped cells are formed in the polyurethane foam.

TABLE 1

| | Average removal rate in treatment of 500 plates in total (Å/min) | Removal rate stability (%) | | |
|---|---|---|---|---|
| | | 100 plates | 300 plates | 500 plates |
| Example 1 | 1030 | 5 | 7 | 9 |
| Example 2 | 980 | 5 | 6 | 7 |
| Example 3 | 1050 | 6 | 7 | 9 |
| Example 4 | 1000 | 5 | 6 | 8 |
| Comparative example 1 | 840 | 7 | 12 | 18 |

As can be seen from Table 1, the polishing pads of the present invention have roughly spherical cells, and further these pads are excellent in durability and removal rate stability because thermosetting polyurethane is used as the material of the polishing layer.

What is claimed is:

1. A polishing pad, comprising a polishing layer arranged on a base material layer, the polishing layer comprising a thermosetting polyurethane foam having roughly spherical interconnected cells with an average cell diameter of 35 to 300 μm, the thermosetting polyurethane foam comprising an isocyanate component and an active hydrogen-containing compound as raw material components, the active hydrogen-containing compound comprising 60 to 85% by weight of a high-molecular-weight polyol having a hydroxyl value of 20 to 100 mg KOH/g.

2. The polishing pad according to claim 1, wherein the thermosetting polyurethane foam is self-adhered to the base material layer.

3. The polishing pad according to claim 1 or 2, wherein the base material layer is a foamed plastic film containing at least one resin selected from the group consisting of polyethylene, polypropylene and polyurethane.

4. The polishing pad according to claim 1 or 2, wherein the base material layer has a thickness of 20 to 1000 μm.

5. A method for manufacturing a semiconductor device, which comprises polishing a surface of the semiconductor wafer with the polishing pad of claim 1 or 2.

6. A method for manufacturing a substrate for a hard disk, which comprises polishing a surface of the substrate with the polishing pad of claim 1 or 2.

7. The polishing pad according to claim 3, wherein the base material layer has a thickness of 20 to 1000 μm.

8. A method for manufacturing a semiconductor device, which comprises polishing a surface of the semiconductor wafer with the polishing pad of claim 4.

9. A method for manufacturing a substrate for a hard disk, which comprises polishing a surface of the substrate with the polishing pad of claim 4.

* * * * *